US005907919A

United States Patent [19]

Keeney

[11] Patent Number: 5,907,919

[45] Date of Patent: Jun. 1, 1999

[54] BARREL AND RECEIVER ASSEMBLY

[75] Inventor: Michael D. Keeney, Elizabethtown, Ky.

[73] Assignee: Remington Arms Company, Inc., Madison, N.C.

[21] Appl. No.: 08/777,261

[22] Filed: Dec. 31, 1996

[51] Int. Cl.[6] ..... F41A 21/00

[52] U.S. Cl. ..... 42/75.02

[58] Field of Search ..... 42/75.02, 75.01, 42/77, 51

[56] References Cited

U.S. PATENT DOCUMENTS

| | | | |
|---|---|---|---|
| 1,065,341 | 6/1913 | Browning | 42/75.02 |
| 1,169,543 | 1/1916 | Johnson | 42/75.02 |
| 1,373,888 | 4/1921 | Johnson | 42/75.02 |
| 2,685,654 | 8/1954 | Crittendon et al. | 42/75.02 |
| 2,747,313 | 5/1956 | Crittendon et al. | 42/75.02 |
| 3,150,458 | 9/1964 | Browning | 42/75.02 |
| 3,177,603 | 4/1965 | Gillespie | 42/75.02 |
| 3,208,178 | 9/1965 | Seiderman | 42/75.01 |
| 3,731,418 | 5/1973 | Birkenhagen et al. | 42/75.02 |
| 3,877,167 | 4/1975 | Keppeler | 42/75.02 |
| 4,109,403 | 8/1978 | Badali | 42/75.02 |
| 4,316,339 | 2/1982 | Herriott | 42/75.02 |
| 4,542,606 | 9/1985 | Hoenig | 42/75.02 |

FOREIGN PATENT DOCUMENTS

| | | | |
|---|---|---|---|
| 2225531 | 12/1973 | Germany | 42/75.02 |

*Primary Examiner*—Charles T. Jordan
*Assistant Examiner*—Theresa M. Wesson
*Attorney, Agent, or Firm*—Huntley & Associates

[57] ABSTRACT

A barrel and receiver assembly providing an improved means of connecting the barrel assembly to the receiver wherein the improved means of connecting the barrel assembly to the receiver comprises a wedge that imparts a force in a direction perpendicular to the barrel, and a means for attaching the barrel assembly to the receiver that imparts a force in a direction parallel to the barrel, and wherein the combination imparts a bi-directional force to the barrel assembly.

18 Claims, 1 Drawing Sheet

BARREL AND RECEIVER ASSEMBLY

BACKGROUND OF THE INVENTION

The present invention relates generally to firearms, and more specifically to a method of, and means for, attaching the barrel and the receiver of the firearm and securing them together.

Proper alignment of the barrel and receiver in firearms is an important factor bearing upon the reliability, safety, and accuracy of the firearm. It is desirable for the barrel and receiver to be properly aligned and securely joined in such a manner that the two joined components are nearly as rigid as a single member. Prior methods of, and means for, attaching the barrel and receiver include pinning or bolting the barrel to the receiver by means of an external fastener, and attaching the barrel to the receiver by threading. Pinning and bolting do not produce a union that approaches the theoretical rigidity of a single member, thus limiting the accuracy of the firearm. Threading is not practical in firearms adapted to fire rimmed ammunition. Accordingly, a need remains for an improved method, and means for, attaching the barrel of a firearm to the receiver.

SUMMARY OF THE INVENTION

The present invention provides an improved means for attaching the barrel of a firearm to the receiver and securing them together, wherein the union of these two components more closely approximates the theoretical rigidity of a single member.

More specifically, the present invention provides, in a firearm having a barrel assembly and a receiver, each having front and rear ends, an improved means for attaching the barrel assembly to the receiver, wherein the front end of the receiver is open ended and adapted to mate with the rear end of the barrel assembly and comprises retaining means and at least one first cam surface, the barrel assembly comprises a barrel and a barrel extension, the barrel extension being adapted to interact with the retaining means of the receiver to establish a forwardmost position for the barrel assembly within the receiver, a wedge having at least one second cam surface adapted to interact with the first cam surface of the receiver, the wedge further comprising a mating surface adapted to interact with the barrel, and attachment means adapted to connect the wedge to the barrel assembly or receiver.

DETAILED DESCRIPTION OF THE INVENTION

Figures 1, 2, 3, 4, 5, 6, 7:
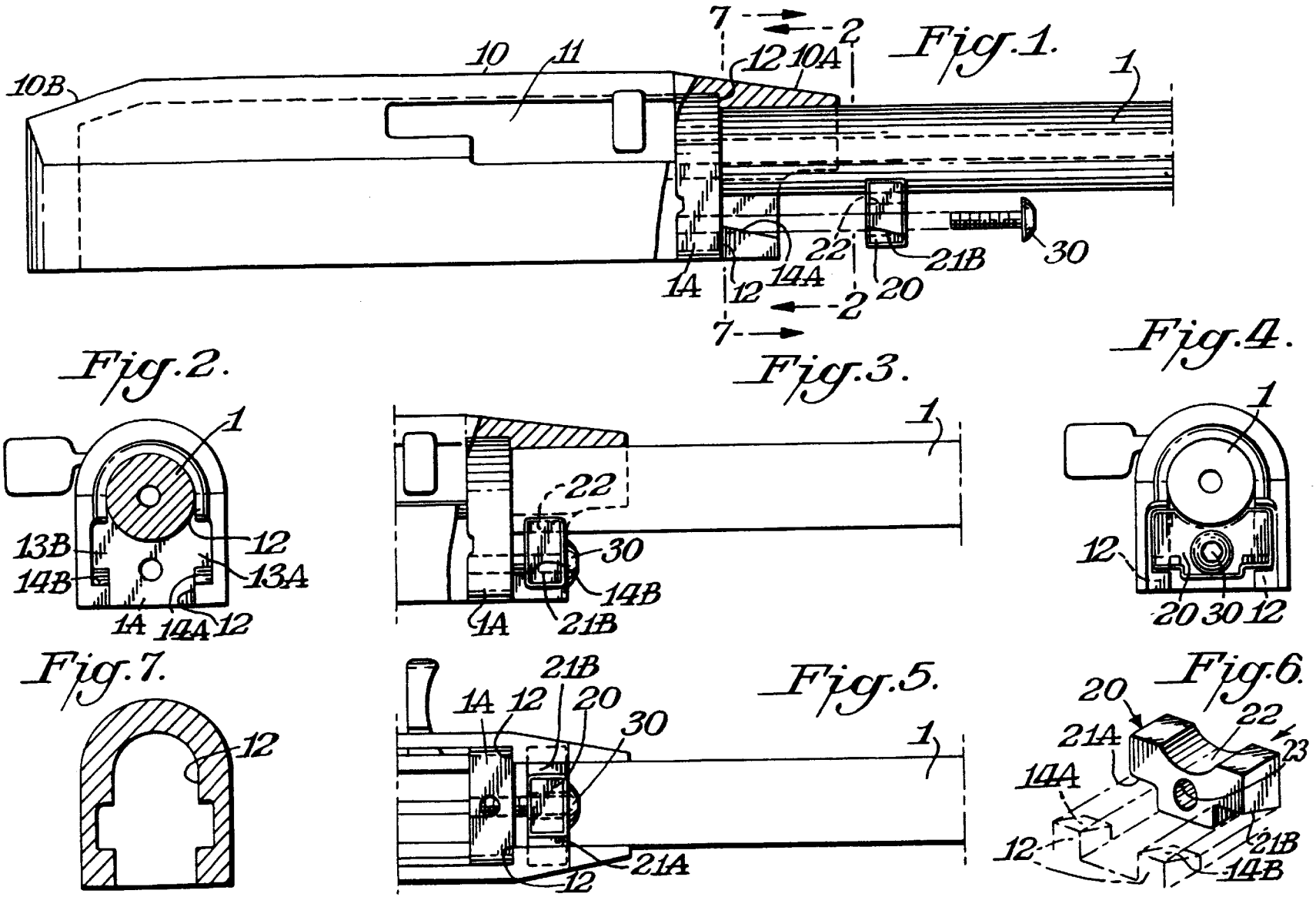
FIG. 1 is a fragmental exploded view partially in cross section showing a receiver and a barrel assembly of the present invention.
FIG. 2 is a front end elevational view of the receiver and a barrel assembly taken along line 2—2 of FIG. 1.
FIG. 3 is a fragmental side elevational view partially in cross section of a receiver and barrel assembly of the present invention, showing the receiver and barrel attached.
FIG. 4 is a front end elevational view of FIG. 3.
FIG. 5 is a bottom plan view of FIGS. 3 and 4.
FIG. 6 is a perspective view showing the first cam surfaces of the receiver and a barrel clamp of the present invention.
FIG. 7 is a rear end elevational view taken at line 7—7 of FIG. 1.

The present invention will be more fully understood by reference to the drawings, which show one embodiment of a barrel and receiver assembly of the present invention. Variations and modifications of this embodiment can be substituted without departing from the principles of the invention, as will be evident to those skilled in the art. In the several drawings, the same numbers are used for like elements.

In FIG. 1, the barrel assembly comprises a barrel 1 and a barrel extension 1A. In the embodiment shown, the rear end of the barrel is threaded, and the barrel extension has a threaded aperture into which the threaded end of the barrel is inserted, securing the barrel and barrel extension together to form the barrel assembly. In alternate embodiments, the barrel assembly can comprise a barrel having a barrel extension as an integral part thereof. The receiver 10, has a front end 10A, a rear end 10B, and an ejection port 11 formed in the side thereof. The ejection port is adapted to permit lateral movement of a bolt handle attached to a bolt (not shown), and to permit the ejection of the casing of a round of ammunition after the round has been fired. FIGS. 2, 4, and 5 show the bolt handle extending through the ejection port.

The front end of the receiver is open ended and adapted to interact with the barrel and barrel extension. Specifically, the front end of the receiver has retaining means 12, which prevent the barrel extension from moving forward within the opening in the front of the receiver. The retaining means can comprise an inwardly extending surface modification on the interior of the front end of the receiver, wherein the surface modification is adapted to interact with the rear end of the barrel or the barrel extension to establish the forwardmost position of the barrel assembly within the receiver. Alternately, the retaining means can comprise a threaded aperture adapted to mate with a threaded rear end of the barrel. The retaining means is shown in the various Figures, especially FIG. 7.

In the embodiment shown, two opposing cam cuts 13A and 13B are formed in the front end of the receiver. Each cam cut has a first cam surface 14A and 14B which extends along an incline from the front of the receiver towards the rear, terminating at a point which includes a portion of the retaining means. In the Figures, the retaining means 12 is positioned towards the rear of the opening in the front end of the receiver. The embodiment of the retaining means shown comprises an inwardly extending lip having a pair of cam cuts which correspond to the rearmost portion of the cam cuts in the front of the receiver. The cam cuts in the retaining means permit the wedge to move rearward until the rear of the wedge contacts the front of the barrel extension. Typically, the wedge need not be forced rearward so as to contact the barrel extension, and in the Figures the wedge is shown in a position forward of the barrel extension.

When the receiver and barrel are connected as shown in FIGS. 3 and 4, the opening in the front of the receiver is defined by the barrel, the cam cuts formed in the sides of the receiver, the first cam surfaces, and the retaining means. The opening is illustrated in FIG. 2. A wedge 20 is adapted to fit into the opening, under the barrel. The wedge has cam followers adapted to interact with the cam cuts in the front end of the receiver, and second cam surfaces 21A and 21B, adapted to interact with the first cam surfaces of the receiver, respectively. Specifically, the second cam surfaces extend along an incline from front to rear, and thus both the first and second cam surfaces rise towards the barrel when the wedge is in the opening in the front of the receiver. The interaction of the first cam surfaces of the receiver and the second cam surfaces of the wedge are shown in FIG. 6.

The wedge has a mating surface 22 adapted to interact with and support the barrel. In the embodiment shown, the mating surface comprises a convex notch on the surface of the wedge substantially conforming to the exterior curvature of the barrel, whereby the barrel rests in the notch of the wedge. The wedge also has an aperture 23 formed therein. The aperture is adapted to interact with the attachment means 30, which, in the embodiment shown, consists of a threaded member adapted to be inserted through the aperture in the wedge and into a threaded aperture in the barrel extension. The aperture in the wedge is elongate to allow for the upward movement of the wedge along the first cam surface as the attachment means is activated to urge the wedge rearward, drawing the barrel assembly forward, and upward as the first and second cam surfaces interact, urging the wedge upward into contact with the barrel.

Other embodiments of the present invention include a wedge that is urged forward and upward into contact with the barrel by a screw, which is threaded through the barrel extension, thus drawing the barrel assembly forward into contact with the retaining means while the wedge applies upward pressure to the barrel, forcing the barrel into alignment with the receiver. Other variations include a barrel assembly wherein a rim formed in the rear end of the barrel comprises the barrel extension, and the retaining means comprises a radial slot formed in the receiver adapted to mate with the rim. In this embodiment, the rim is inserted into the radial slot joining the barrel assembly and receiver, and wherein a wedge is adapted to be inserted under the barrel, securing the joined components by preventing the rim from disengaging the slot while also urging the barrel upward.

Other variations include a barrel assembly wherein a radial groove on the rear end of the barrel assembly separates the barrel from the barrel extension, and the retaining means of the receiver comprises an inwardly extending lip adapted to interact with the groove to establish the position of the barrel assembly relative to the receiver.

The improved mechanism of the present invention, in its various possible embodiments, provides a means of connecting a barrel assembly to a receiver to produce a more rigid union that more closely approximates a single member. The present invention, with the wedge acting as a wedge, will lock the barrel assembly and receiver together. By means of mating angled surfaces on the wedge and the receiver, a two directional clamping force is achieved. Tightening of the wedge screw draws the barrel assembly forward and upward, urging the wedge between the barrel assembly and the receiver.

Furthermore, the present invention provides additional benefits when used in firearms adapted to fire rimmed ammunition. In such firearms, it is not practical to attach the barrel to the receiver by threading, the standard method for non rimmed ammunition, due to the radial alignment requirement of the extractor cut in the barrel face and the extractor contained in the bolt. In such firearms, the extractor is a hook adapted to fit around the rim of the ammunition and extends forward of the face of the bolt. The extractor thus requires lateral clearance to fit around the edge of the rim to grab the ammunition and pull it out. The requirement for clearance makes it necessary to place a longitudinal cut in the barrel, and this cut must be aligned with the extractor in the bolt. Due to manufacturing tolerances, it is difficult to precut the barrel in a position to be aligned with the extractor cut because the exact position of the barrel when it has been threaded into the receiver or barrel assembly cannot be accurately predetermined. Accordingly, the present invention is also well suited for use in a firearm adapted to fire rimmed cartridges, including both centerfire and rimfire.

I claim:

1. In a firearm having a barrel assembly and a receiver, each having front and rear ends, wherein the front end of the receiver is adapted to mate with the rear end of the barrel assembly, and the barrel assembly comprises a barrel and a barrel extension, an improved means for attaching the barrel assembly to the receiver, comprising at least one retaining means in the front end of the receiver adapted to interact with the barrel assembly to establish a position for the barrel assembly with respect to the receiver;

at least one first cam surface in the front end of the receiver;

a wedge having at least one second cam surface adapted to interact with the first cam surface of the receiver, the wedge further comprising a mating surface adapted to interact with the barrel, and attachment means adapted to connect the wedge to at least one element selected from the group consisting of the barrel assembly and the receiver.

2. A firearm of claim 1 wherein the barrel assembly comprises a barrel and barrel extension, each having front and rear ends, wherein the front end of the barrel extension is adapted to be operatively connected to the rear end of the barrel.

3. A firearm of claim 2 wherein the barrel extension has a threaded aperture adapted to engage a threaded rear end of the barrel.

4. A firearm of claim 1 wherein the barrel assembly is a single unit comprising a barrel having a barrel extension.

5. A firearm of claim 1 wherein the barrel extension protrudes laterally beyond the perimeter of the barrel in at least one direction.

6. A firearm of claim 1 wherein the barrel extension protrudes radially beyond the perimeter of the barrel.

7. A firearm of claim 1 wherein the barrel assembly further comprises a radial groove separating the barrel from the barrel extension.

8. A firearm of claim 7 wherein the retaining means of the receiver comprises a ridge adapted to interact with the radial groove in the barrel assembly to establish the position of the barrel assembly within the receiver.

9. A firearm of claim 1 wherein the barrel assembly further comprises an aperture in the barrel extension adapted to interact with the attachment means, the wedge further comprises an elongate aperture adapted to be substantially aligned with the aperture in the barrel extension when the wedge is positioned to interact with the receiver.

10. A firearm of claim 9 wherein the attachment means is inserted through the elongate aperture in the wedge and into the aperture in the barrel extension.

11. A firearm of claim 9 wherein the elongate aperture is adapted to permit the wedge to move in a direction perpendicular to the attachment means and the barrel assembly while also moving in a direction substantially aligned with the barrel assembly.

12. A firearm of claim 9 wherein the attachment means is inserted through the elongate aperture of the wedge and into the aperture in the barrel extension, the attachment means being adapted to force the barrel assembly into contact with the retaining means of the receiver and into alignment with the receiver.

13. A firearm of claim 1 wherein the attachment means comprises at least one selected from the group consisting of screw, bolt, and pin.

14. A firearm of claim 1 wherein the first cam surface of the receiver further comprises a rearward terminal surface extending perpendicularly to the receiver and the barrel assembly, said surface comprising at least a portion of the retaining means of the receiver.

15. A firearm of claim 1 wherein the first cam surface of the receiver begins at a point in or about the front of the receiver and terminates at a point towards the rear of the receiver.

16. A firearm of claim 15 wherein the point at which the cam surface terminates is elevated relative to the point at which it begins.

17. A firearm of claim 1 wherein the attachment means is a threaded screw adapted to interact with a threaded aperture in the barrel extension, and wherein the screw is inserted through the wedge and into the aperture in the barrel extension, whereby the rotation of the screw draws the barrel assembly forward into contact with the retaining means, and also forces the wedge rearward, and the interaction of the second cam surface of the barrel clamp with a rearwardly inclined first cam surface causes the barrel clamp to exert an upward force on the barrel.

18. A firearm of claim 1 wherein the mating surface of the wedge comprises a concave depression conforming to a circumferential segment of the barrel.

* * * * *